US005911376A

United States Patent [19]

Scaglia

[11] Patent Number: 5,911,376

[45] Date of Patent: Jun. 15, 1999

[54] SYSTEM TO IDENTIFY GRIP POSITION AND MANIPULATE BOBBINS

[75] Inventor: Enzo Scaglia, Milan, Italy

[73] Assignee: Scaglia SpA, Brembilla, Italy

[21] Appl. No.: 08/939,122

[22] Filed: Sep. 26, 1997

[30] Foreign Application Priority Data

Apr. 17, 1997 [IT] Italy ..... UD97A0073
May 23, 1997 [IT] Italy ..... UD97A0097

[51] Int. Cl.[6] ..... B65H 75/10; B65H 49/00; A45F 5/00

[52] U.S. Cl. ..... 242/118.32; 242/129.51; 242/130.2; 294/93; 294/158

[58] Field of Search ..... 242/118.32, 118.4, 242/129.51, 130.2, 473.6; 294/93, 158

[56] References Cited

U.S. PATENT DOCUMENTS 1,692,441 11/1928 Hasbrouck ..... 242/130.2
2,450,966 10/1948 Keight ..... 242/118.32
2,690,885 10/1954 Crooks ..... 242/118.4 X
3,079,104 2/1963 Cochran ..... 242/118.32 X
4,086,999 5/1978 McDonald ..... 294/93 X
4,600,165 7/1986 Shoemaker ..... 242/118.4
4,919,363 4/1990 Kitamura ..... 242/130.2

*Primary Examiner*—Michael Mansen
*Attorney, Agent, or Firm*—Antonelli, Terry, Stout & Kraus, LLP

[57] ABSTRACT

System to identify, grip, position and manipulate bobbins used to wind thin and very thin thread and yarns, such as yarns for women's stockings, the bobbins able to be associated with vertical systems (22) or horizontal systems (24) to make the bobbins rotate, the bobbins achieving speeds of rotation, during the winding step, of 28/30,000 revolutions per minute, the bobbin including a central body (11) with an inner axial cavity (26) and ends with flanges (12), the flanges (12) defining at the front an annular positioning seating (13) for a count-marker identification element (20), the system comprising a hand-grip element (16) axial to the bobbin (10) and cooperating with one end of the bobbin (10) and anchored to the inner axial cavity (26) and including gripping and manipulating means (18) outside the bobbin (10) and, at least during the winding step, the system comprising a centering element (14) associated with the other end of the bobbin (10) and cooperating, during the winding step, with the means (22,24) to make the bobbin (10) rotate, at least the hand-grip element (16) including means of axial contact with the count-marker identification element (20).

9 Claims, 2 Drawing Sheets

10
11
12
13
14
15
16
17
18
19
20
22
22a
23
24
25
26
39
40
119
R

SYSTEM TO IDENTIFY GRIP POSITION AND MANIPULATE BOBBINS

BACKGROUND OF THE INVENTION

This invention concerns a system to identify, grip, position and manipulate bobbins.

The invention is applied particularly, but not exclusively, to position, manipulate and transport bobbins made of aluminum or its alloys after thin or very thin yarns, such as for example yarns for women's stockings, have been wound onto them. The problems relating to the identification, manipulation and transport of aluminum bobbins used to support thin and very thin yarns, such as those for women's stockings or other similar yarns, are known to the state of the art. The reels obtained after winding are cylindrical or like the double trunk of a counter opposed cone.

The yarn is wound on the bobbins at speeds which can reach up to 28/30,000 revolutions per minute.

The yarn can be wound onto the bobbins with a vertical axis, as in the classical arrangement of a spinning machine, or with a horizontal axis, as the bobbin is constrained by tailstocks.

But also in the vertical arrangement the bobbin can be arranged between tailstocks.

Given their extremely limited thickness, the threads are very sensitive and the merest contact with the fingers of the machine operator is enough to disarrange them and make automatic unwinding impossible, or in any case ruin the threads.

For this reason, the reels must not only be correctly identified by the appropriate identification devices, given the wide range of types of threads or yarns which they can carry in a wound state, they must also be manipulated with great care and attention by the machine operators, who must take care that they do not contact the wound thread or yarn or allow it to be contacted by any element.

A further problem is that it is difficult to constrain in a correct position of identification the identification devices on the bobbins during the winding step, because of the very high speeds reached. The identification devices, moreover, must be sufficiently big so as to be easily identified, in order to reduce the time needed to look for and select them, and also to reduce the risk of errors.

SUMMARY OF THE INVENTION

The present applicants have designed and tested this invention to overcome the shortcomings not sufficiently resolved by the state of the art, and to obtain further advantages as will be shown hereinafter.

The main purpose of the invention is to obtain a system to grip, position and manipulate bobbins which will solve the problems involved with positioning and centering the bobbin on the respective winding means, and also the problem of gripping, manipulating and positioning the bobbins after a particularly delicate thread has been wound onto them.

Another purpose is to provide identification means which are ample and easy to identify. A further purpose is to guarantee a stable and secure positioning for the bobbin identification means, for example a count-marker, even when the speed of rotation during winding is 28/30,000 rpm.

According to the invention, at least one end of the bobbin is made to cooperate, during the winding step, with a centering element placed axial to the bobbin.

In a first embodiment, the centering element is solid with the bobbin.

According to a variant the centering element may be removed from the bobbin.

According to the invention the bobbin cooperates axially with a hand-grip element.

According to a variant, the hand-grip element is made temporally solid with the bobbin and can be removed if necessary or useful.

According to a variant of the invention, the hand-grip element, and/or the centering element, has a lead-in and positioning bevel.

The identification element, of the type including a ring which is at least partly elastic in a radial direction, cooperates, according to the invention, with the lead-in bevel, in such a way that the lead-in bevel maintains the identification element in the correct position in cooperation with one or both extremities of the bobbin.

This position of the identification element lies substantially on a plane perpendicular to the axis of the bobbin.

According to a further variant of the invention, the hand-grip element, and/or the centering element, has a covering ring which extends at least partly above the count-marker and ensures that it is held in position even during the usual and very high speeds of rotation which the bobbin achieves during the winding of the yarn.

According to the invention, the centering element has a through hole to cooperate with a vertical spindle or with a centering and rotation system with tailstocks.

According to a variant, the hand-grip element has centering means with respect to the vertical spindle or with respect to the centering and rotation system with tailstocks.

According to a variant, the bobbin includes, on at least one side, a raised ring which functions as a temporary hand-grip. This kind of raised ring is particularly useful in the case of gripping and manipulating the bobbin with automatic means for gripping, manipulating and/or transporting the bobbin.

The automatic means for gripping, manipulating and/or transporting the bobbin, according to a variant of the invention, are associated with monitoring and identification means using a count-marker, to give an automatic or semi-automatic management of the store of empty bobbins and bobbins with wound thread.

This kind of raised ring, which can be present in one or both heads of the bobbin, includes an axial element and a circumferential ring element so as to define an annular cavity around the axial hole of the bobbin and outside at least one flange of the said bobbin.

According to a variant, the axial element is cylinder shaped.

According to another variant, the axial element is shaped like a truncated cone with the top on the axis of the bobbin.

With this kind of raised ring, it is possible to grip the bobbin both temporally by hand, and also automatically using either the annular cavity or the outer part of the truncated cone or of the cylinder.

Such a conformation can also cooperate with the hand-grip means and with the centering means.

In the presence of the raised ring, the positioning seating of the count-marker is located inside and near the flange of the bobbin.

According to a variant, the hand-grip element substantially closes the axial hole in the raised ring, and prevents the count-marker from being able in any way to come out during rotation.

According to the invention, the count-marker is structured like a split ring and is suitable to be positioned in a seating or groove obtained in cooperation with at least an end flange or head of the bobbin.

BRIEF DESCRIPTION OF THE DRAWINGS

The attached figures are given as a non-restrictive example, and show some preferred embodiments of the invention as follows.

DETAILED DESCRIPTION OF THE PREFERRED EMBODIMENT

Figures 1, 2A, 2B, 2C, 3:
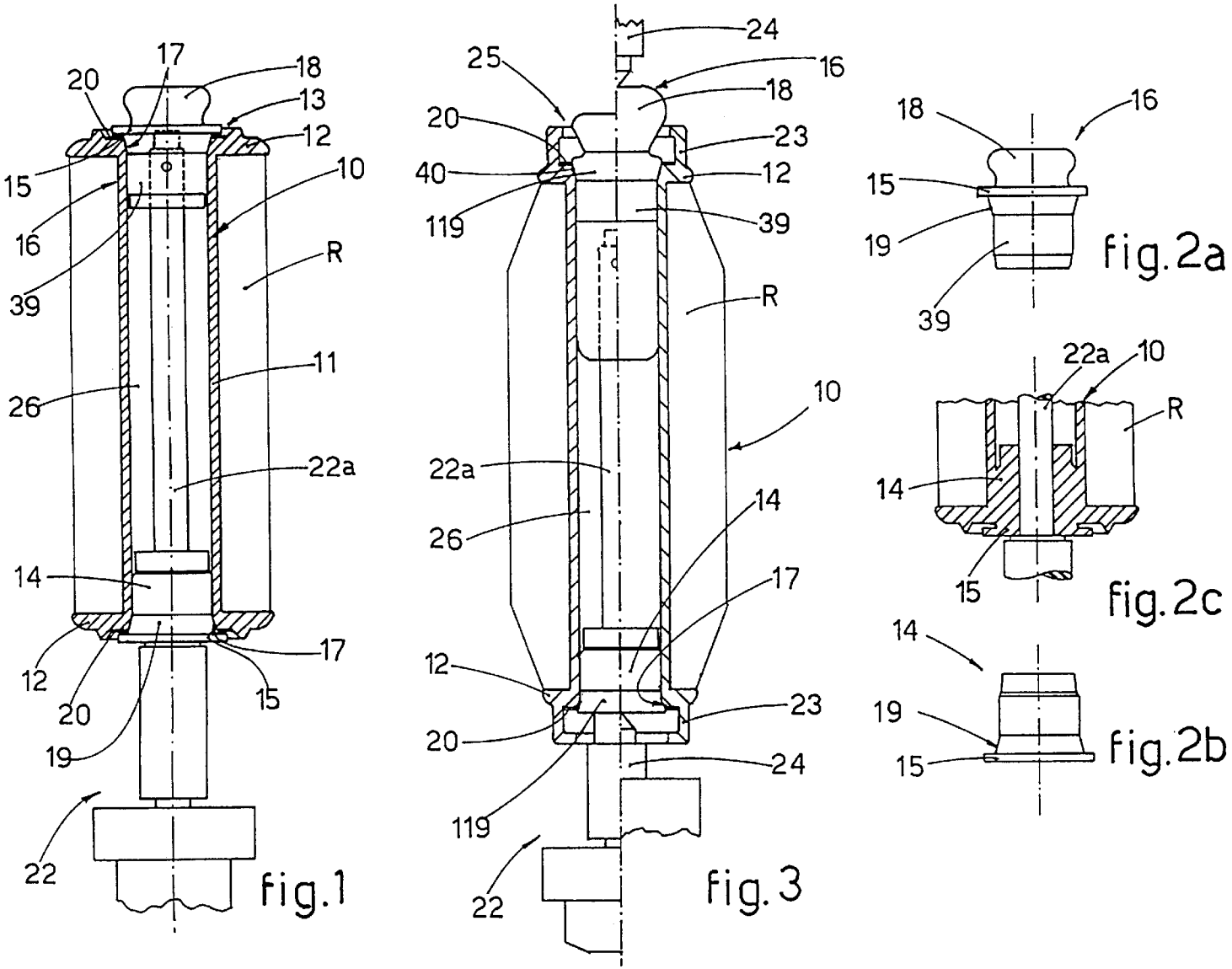
FIG. 1 shows a bobbin according to the invention and the means to achieve the system according to the invention.
FIG. 2*a* shows a possible embodiment of a hand-grip element according to the invention.
FIG. 2*b* shows a possible embodiment of a centering element according to the invention.
FIG. 2*c* shows an embodiment of the centering element as an integral part of the bobbin.
FIG. 3 shows a variant of the invention.
Figure 5A:
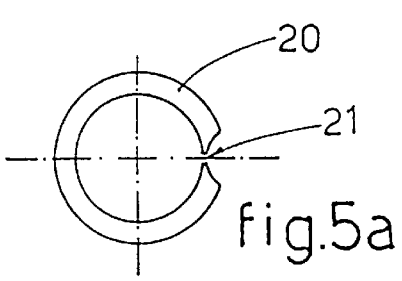
FIG. 5*a* shows a count-marker according to the invention.
Figure 5B:
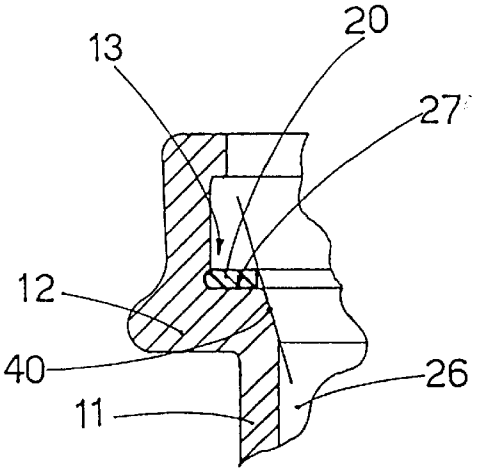
FIG. 5*b* shows the relative seating in the embodiment of FIG. 3.

The bobbins 10 shown in FIGS. 1 and 3 are made of aluminum and suitable to wind thin or very thin threads or yarns, such as for example yarns for women's stockings or similar.

The reel R of yarn obtained by the bobbin 10 is normally substantially cylindrical (FIG. 1), but can also have tapering ends (FIG. 2).

The bobbin 10 has a central body 11 defining an inner axial cavity 26 and associated with end flanges 12. The inner axial cavity 26 may be of various shapes.

The bobbin 10, shown in FIG. 1, is in this case used to wind vertically and is used in a conventional spinning machine, of which a spindle support 22 is partly shown.

Another bobbin 10 is shown in FIG. 3 which in this case is associated with tailstocks so that it can be made to rotate and wound.

In this case each flange 12 has an annular positioning seating 13 at the front wherein the count-marker 20 finds positioning and housing.

In the case of FIG. 1, according to the invention, the first end the bobbin 10 cooperates during winding with a relative centering element 14 inserted through part of the inner cavity 26.

The centering element 14 has the positioning ring 15 partly resting on the count-marker 20 present in the annular positioning seating 13 so that the count-marker 20 is visible but cannot move, at least during the winding step.

The centering element 14 in this case has an axial through hole so that an element 22*a* of the vertical spindle can be inserted and positioned substantially for the whole height of the bobbin 10.

The centering element 14, in the embodiment shown in FIG. 2*c*, is solid with the bobbin 10.

According to a variant, the centering element 14 is an autonomous component which can be associated with the bobbin 10 from time to time as needed.

Still in the case of FIG. 1, the bobbin 10 cooperates at the other end with a hand-grip element 16 which is inserted by means of a lengthwise extension 39 for at least a segment of the inner cavity 26 and is constrained by contact with the walls thereof.

The constraint by contact can be obtained either by expanding the lengthwise extension 39 or by including friction means around the lengthwise extension 39. It is within the ability of a skilled person to achieve this contact mechanically and also to make the contact removable also with mechanical means of the automatic type or activated by remote control.

The hand-grip element 16 has its own positioning ring 15 which partly rests on the count-marker 20 present in the base of the annular seating 13 so that the count-marker 20 is visible but cannot move, at least during the winding step.

The hand-grip element 16 is shaped ergonomically at the upper part 18 which protrudes outside the bobbin 10 and thus can be easily and securely gripped by the machine operator.

In this case, the hand-grip element 16 has a partial axial hole which allows the end of the element 22*a* of the vertical spindle to be inserted.

According to a variant of the invention, below the positioning ring 15, both the hand-grip element 16 and the centering element 14 have a lead-in bevel 19 which, cooperating with the bevel 17 in the bobbin 10, allows the bobbin 10 to be correctly centered.

In the case (FIG. 3) in which the lead-in bevel 119 extends in substitution for the positioning ring 15, the said lead-in bevel 119 cooperates with the count-marker 20 which is present in the annular positioning seating 13 resting on the base 27 of the said seating 13, clamping the count-marker 20 and preventing it from escaping during rotation.

To this end, the base 27 extends at the lower part into a bevel 40, which has an angle of inclination mating with the lead-in bevel 119 of the hand-grip element 16.

According to the invention, it makes no difference whether the positioning ring 15 is adopted for the bobbin of FIG. 3 or the extended lead-in bevel 119 is adopted for the bobbin of FIG. 1.

In this case, the count-marker 20 consists of a ring which is split at 21 so that it can be elastically inserted into the annular positioning seating 13.

The embodiment shown in FIG. 3 refers to a bobbin 10 of the type with a raised ring 23 present in this case at both ends and associated with the end flange 12.

In this case the bobbin 10 can be used (solution shown on the right) in cooperation with winding means which wind horizontally or vertically, for example tailstocks 24 which are partly shown in diagram form, while the solution shown on the left uses a vertical spindle 22.

The reels R obtained with the bobbin 10 can be cylindrical, or like the double trunk of a counter opposed cone, as shown in the Figures.

In the case of a bobbin 10 with a raised ring 23, the section of the hand-grip 16 is such as to at least partly close the axial hole 25 of the raised ring 23 so that the count-marker 20 not only is held in position by the element 15 or the element 119 but also it finds a possible way out through the hole 25 which is at least partly filled by the hand-grip 16.

Figure 4B:
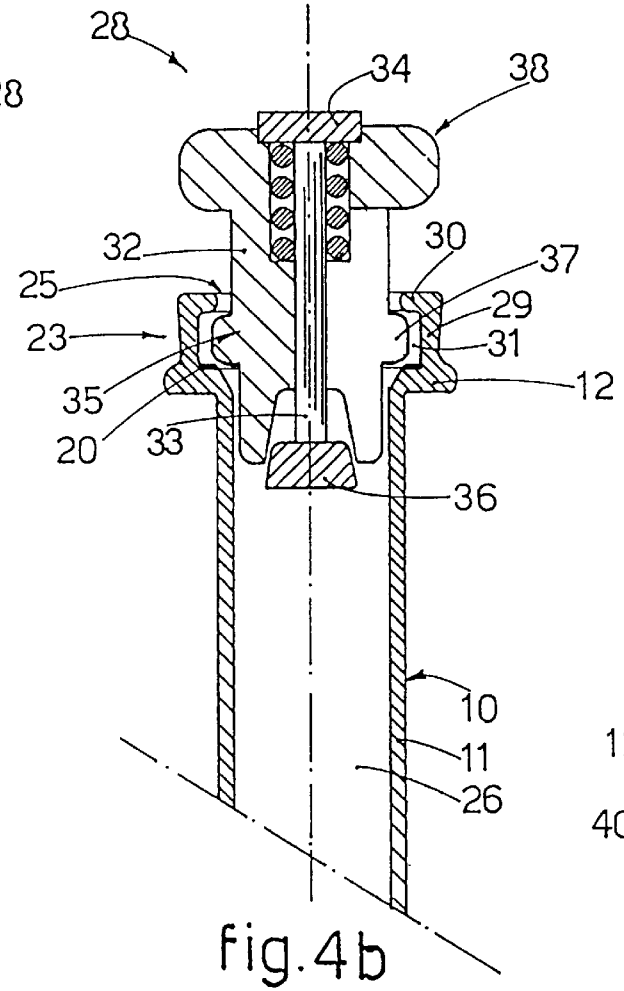
FIG. 4*b* shows another variant of FIG. 3 combined with automatic manipulators.
Figure 4A:
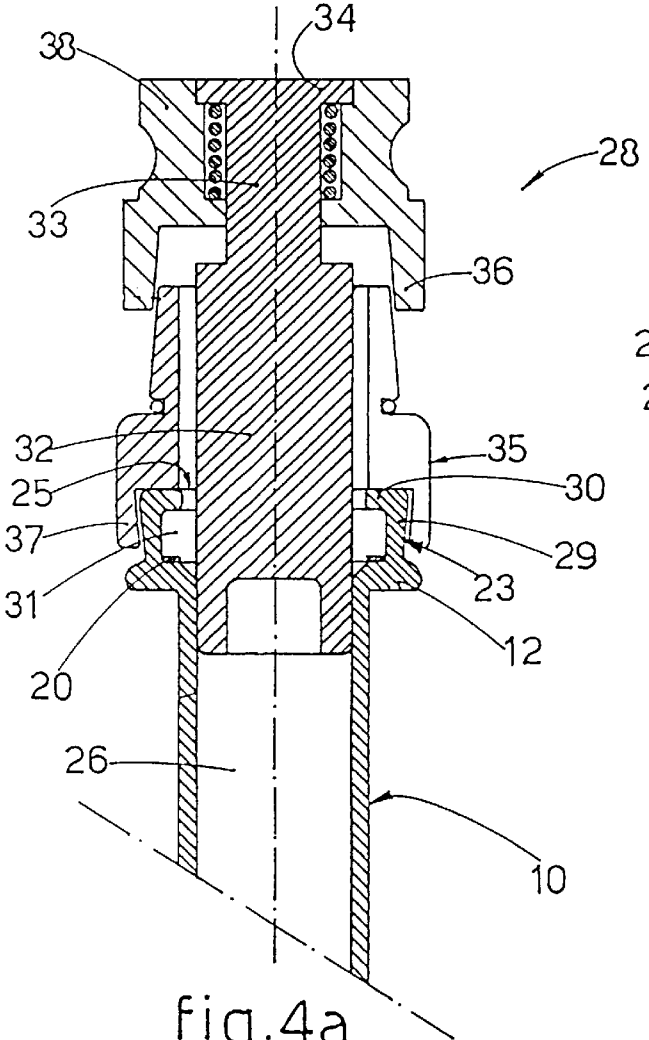
FIG. 4*a* shows a variant of FIG. 3 combined with automatic manipulators.

In FIGS. 4*a* and 4*b* a gripper and manipulator device 28 suitable for adoption also by automatic gripping and manipulating means is shown associated with a bobbin 10 with a raised ring 23.

FIGS. 4*a* and 4*b* show the gripper and manipulator device 28 in its position of release from the bobbin 10, that is to say, in the position wherein it is unconstrained and can be removed from the bobbin 10.

The raised ring 23 is structurally associated with the relative end flange 12 and includes an axial element 29 and a ring element 30 which defines the axial hole 25. The axial element 29 and the ring 30 define an annular cavity 31 with respect to the end flange 12.

The gripper and manipulator device 28 comprises a central body 32 suitable to be inserted at least partly into the inner axial cavity 26 of the bobbin 10 in order to center the bobbin 10 and to keep it stable during the steps of gripping, manipulating and transport.

According to a variant, the axial element 29 of the raised ring 23 has a development which is partly like a truncated cone tapering downwards and towards the center and the axis of the bobbin 10.

The central body 32 of the gripper and manipulator device 28, in this case, is solidly associated with a rod 33 connected at the upper part with an activation push-button 34 which is elastically contrasted.

The gripper and manipulator device 28 moreover comprises an anchorage element 35 and clamp/release means 36.

The clamp/release elements 36 are associated with activation means 34 which can be activated from outside and are elastically contrasted.

The anchorage element 35 consists of two or more parts which are constrained together elastically and can be activated by means of the clamp/release means 36.

The anchorage element 35 has a lower portion 37 which in the case of FIG. 4*a* is shaped like a truncated cone which is anchored to the outside of the axial element 29 of the raised ring 23 while in the case of FIG. 4*b* it has means which are anchored in the annular cavity 31.

The upper part 38 is shaped both for automatic gripping and manipulating and also for manual gripping.

It is within the ability of any skilled person to geometrically shape the gripper and manipulator device 28 according to the use and the manipulator means, once he has understood how they can cooperate with the bobbin 10.

I claim:

1. System to identify, grip, position and manipulate bobbins used to wind thin and very thin thread and yarns, comprising: a bobbin including a central body with an inner axial cavity and ends with flanges, the flanges defining at a front an annular positioning seating; a count-marker identification element provided in the annular positioning seating; a gripper element axial to the bobbin and cooperating with one end of the bobbin, anchored to the inner axial cavity, the gripper element including gripping and manipulating means outside the bobbin; and, at least during a step of winding the bobbin, a centering element associated with the other end of the bobbin and cooperating, during the step of winding, with means to make the bobbin rotate, and wherein at least the gripper element includes contact means for contacting the count-marker identification element to hold the count-marker identification element in place.

2. System as in claim 1, in which the contact means comprises a positioning ring.

3. System as in claim 1, in which the contact means comprises lead-in bevel.

4. System as in claim 1, in which at least one end flange of the bobbin has a raised ring defining an annular cavity and an axial hole.

5. System as in claim 4, in which the raised ring has an axial element and a ring element defining the axial hole.

6. System as in claim 5, in which the axial element is shaped like a truncated cone tapering downwards towards the bobbin.

7. System as in claim 4, in which the gripping and manipulating means of the gripper element is slightly smaller in section than the axial hole, as the gripping and manipulating means extends outside the raised ring.

8. System as in claim 1, in which the count-marker identification element is shaped like a split ring.

9. System as in claim 1, in which the centering element is an integral part of the bobbin.

* * * * *